US005525948A

United States Patent [19]

Poulsen

[11] Patent Number: 5,525,948

[45] Date of Patent: Jun. 11, 1996

[54] MANUALLY OPERATED, ELECTROMAGNETICALLY RESETTABLE SAFETY SWITCH

[76] Inventor: Peder U. Poulsen, Huntington Rd. Box 197, Stratford, Conn. 06497

[21] Appl. No.: 348,405

[22] Filed: Dec. 2, 1994

[51] Int. Cl.[6] ..... H01H 67/02

[52] U.S. Cl. ..... 335/128; 335/78

[58] Field of Search ..... 335/78–86, 128, 335/231, 177–79

[56] References Cited

U.S. PATENT DOCUMENTS

| | | | |
|---|---|---|---|
| 3,142,784 | 7/1964 | Bloomfield | 335/177 |
| 3,760,310 | 9/1973 | Carson | 335/146 |
| 5,227,750 | 7/1993 | Connell et al. | 335/86 |

*Primary Examiner*—Lincoln Donovan
*Attorney, Agent, or Firm*—John H. Crozier

[57] ABSTRACT

A manually operated on-off switch comprising a frame with a magnetizable core surrounded by windings, and a spring loaded armature moveable between open and closed positions relative to the frame, the armature carrying a plurality of moving contacts which interact with stationary, normally open and normally closed contacts, and a manual rocker or toggle operator or the like attached to or acting upon the armature and serving to either close it against the spring action until it is held closed by electromagnetic force, or break it open against said holding force; a second embodiment of the switch described above comprising in addition a separate winding consisting of relatively few turns of heavy wire connected in series with the load and arranged to produce a field counteracting the field of the holding coil, the objective being to release the armature and open the working contacts when the load reaches a predetermined maximum value; and a third embodiment comprising in addition motor braking means in the form of a circuit serving to inject a brief pulse of direct current into the motor windings through the normally closed contacts mentioned as soon as the switch is either manually opened or magnetically reset.

22 Claims, 3 Drawing Sheets

MANUALLY OPERATED, ELECTROMAGNETICALLY RESETTABLE SAFETY SWITCH

BACKGROUND OF THE INVENTION

1. Field of the Invention.

The present invention relates to switches in general and particularly to manual on-off switches for controlling hazardous machinery.

2. Background Art.

Rules and regulations governing design and operation of machinery often specify safety features including special electrical control systems designed to protect workers and prevent accidents. Such safely features are required in many categories of woodworking machines, e.g. circular saws, routers and planers, and metalworking machines including drill presses, punch presses and shears as well as many other types. The following are examples of safety features often incorporated in machinery and sometimes demanded by law.

On-off switches, easily accessible from the operator's position.

Guards protecting the operator from hazards created by ingoing nip points, rotating parts, and various kinds of cutters and blades. Guards are often provided with limit switches which render the machine inoperative if they are opened or removed. Examples are blade guards on circular saws, guards protecting the daylight area on presses and covers guarding interchangeable gears on lathes.

Two hand tripping devices used to ensure that both hands are kept clear of dangerous areas during operation. Two-hand devices often consist of two palm switches which must be depressed simultaneously to start a work cycle.

No-voltage-trip systems. These prevent hazardous, uncontrolled restart of equipment when a remote, tripped circuit breaker is closed or when power is restored after a power failure.

Maximum torque circuit breakers. These usually sense the motor current and are designed to trip instantaneously if a motor is stalled or overloaded beyond a predetermined limit. This type of protection is sometimes used on rotating machinery such as drill presses or lathes which may snag onto an operator's hair or clothing during operation.

Braking systems serving to prevent hazardous coasting of a machine after the power is cut off. Electrical braking of AC motors is often accomplished by applying a brief pulse of DC to the field windings immediately as a machine is turned off.

Incorporating all or a majority of the above features in a machine usually requires several electrical control components such as on-off switches, a magnetic motor starter, a magnetic overload circuit breaker and a motor braking circuit etc.

Attempts have been made to combine some of the functions described above into a single assembly such as for example on-off switches combined with magnetic or thermal circuit breakers, or magnetically latching push-button switches. These types of switches have certain features in common with the switch according to the invention and are described in U.S. Pat. Nos. 1,839,629, 3,161,743 and 3,622,925. They were designed to operate loads such as e.g. clothes dryers and elevators and have push-buttons used to start a work cycle which is then shut off automatically by means of a thermostat, a timer or a limit switch.

A different category of hybrid safety devices, the self-protected motor starters, include a magnetic motor controller and an overload relay. These have separate magnetic circuits but usually just one set of contacts serving both the contactor and circuit-breaker functions. In the majority of cases operation is initiated by means of a push-button switch which serves to energize the solenoid in the motor controller, and a holding circuit serves to keep the starter closed after the push-button is released. The holding circuit incorporates one normally open contact and one or several normally closed contacts connected in series. One of these contacts may be a stop push-button while another may be operated by a timer, a counter or a limit switch in order to stop the process in case of malfunction or after a work cycle is completed.

SUMMARY OF THE INVENTION

The object of the present invention is to provide a novel, safety on-off switch or controller in the form of a single, easily installed, compact and inexpensive assembly. An on-off switch according to the invention contains all of the electrical control means required for any or all of the safety features described in the above. It can be configured e.g. as a two button device, a rocker switch or a toggle switch, all within the scope of the invention. The invention will be described in the following with reference to the drawings which depict preferred embodiments and diagrams.

BRIEF DESCRIPTION OF THE DRAWING

The invention will be described in the following with reference to the drawings in which.

DETAILED DESCRIPTION OF THE PREFERRED EMBODIMENTS

Figure 1:
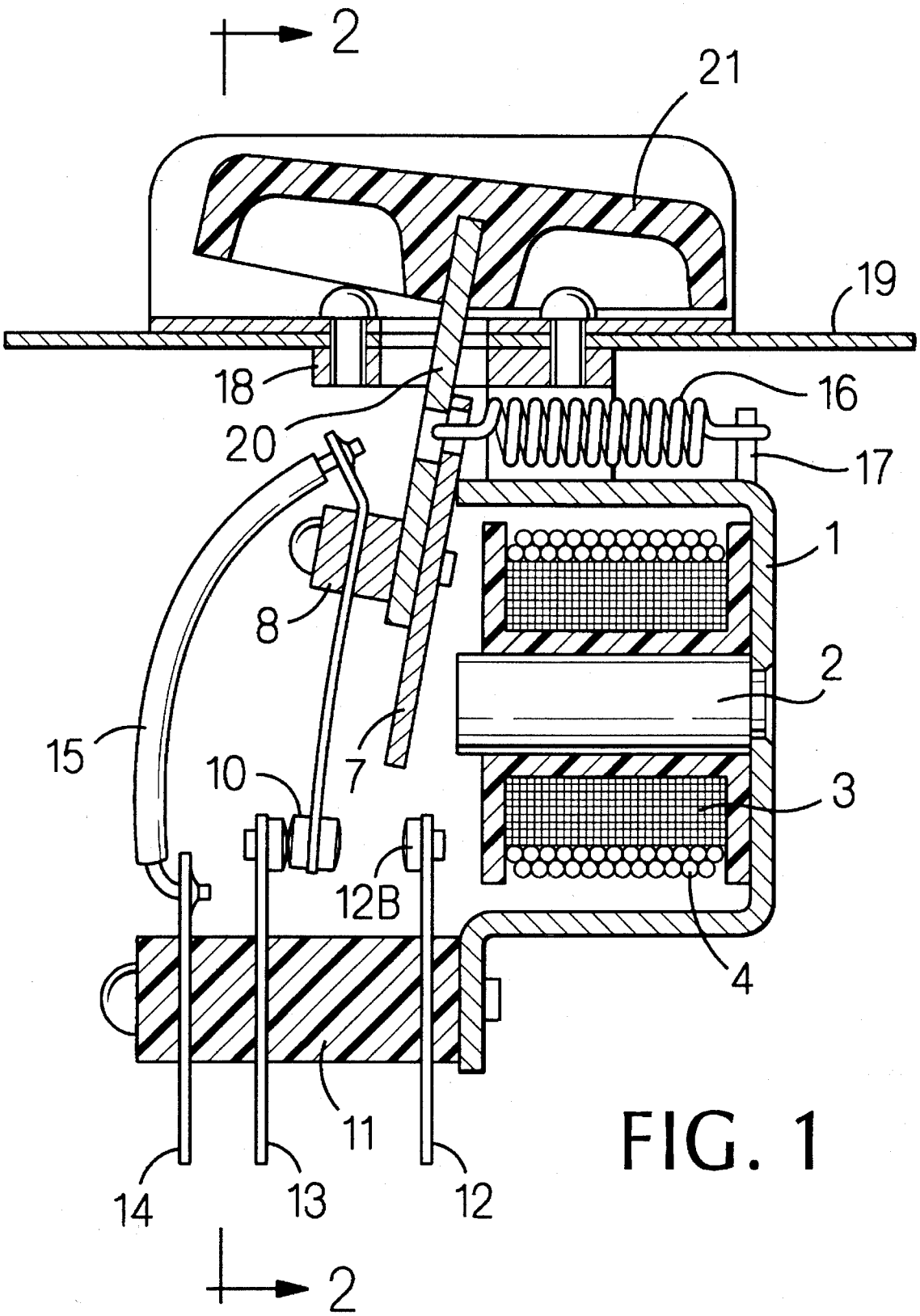
FIG. 1 is a sectional, elevational view through a preferred embodiment of an on-off switch according to the invention along lines 1—1 of FIG. 2.
Figure 2:
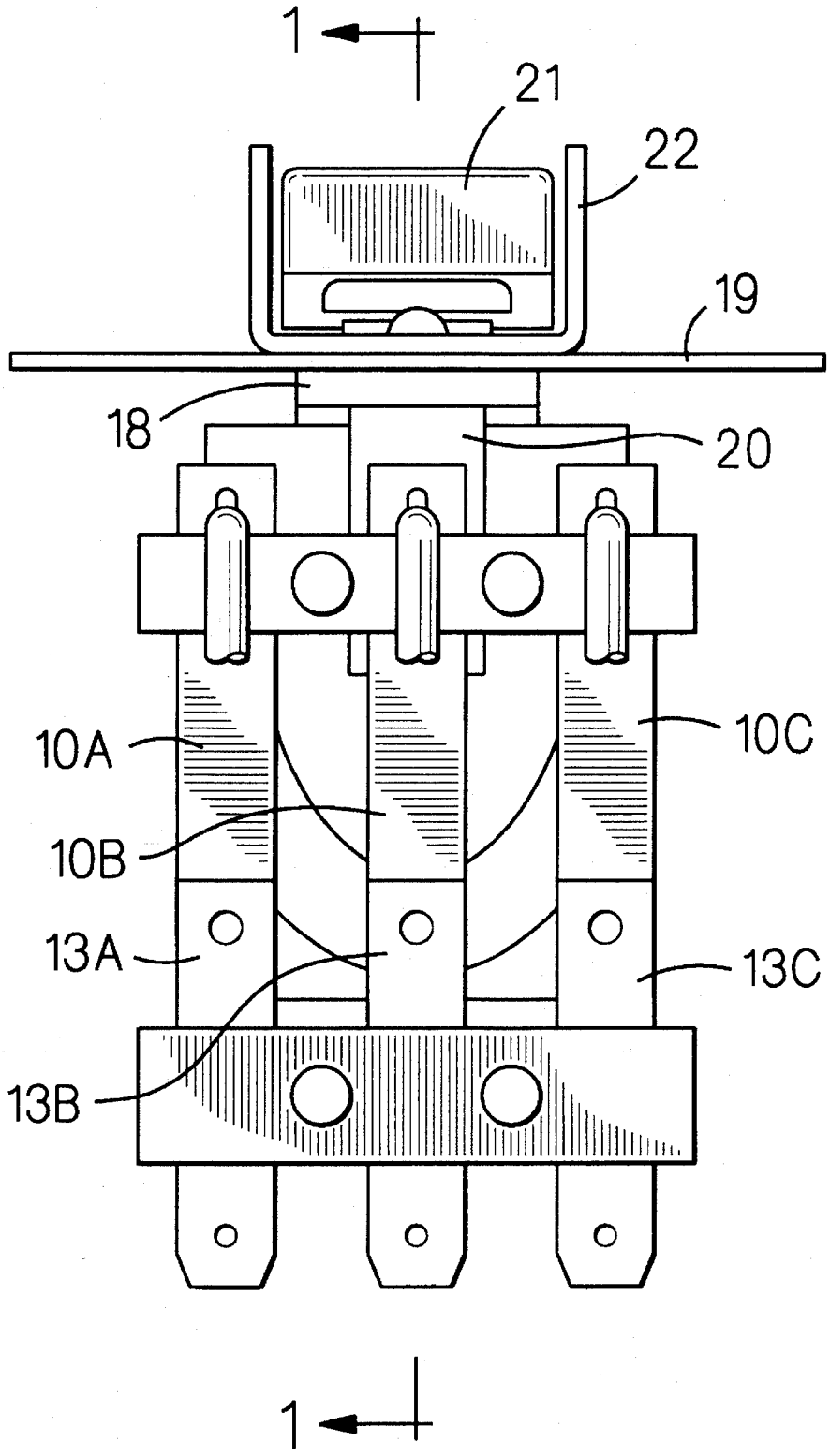
FIG. 2 is a side elevational view of same shown partly in section along lines 2—2 of FIG. 1.

A substantially U-shaped magnetic frame 1 is provided with a magnetizable core 2, which is surrounded by windings 3 and 4. The length of the core 2 is approximately the same as the length of the upper leg 5 of frame 1, the frame and the core comprising together a magnetic circuit which may be energized by means of windings 3 and 4. Pivotally supported adjacent the free end of the frame leg 5 is an armature 7, which extends over the core 2. Extending from one side of the armature 7 is an insulating, contact supporting block 8 onto which is mounted one or a plurality of springs 10, each provided with a double sided contact mounted near its end. Another contact supporting, insulating block 11 is mounted onto the lower leg of frame 1, carrying one or a plurality of springs 12 and 13 with stationary contacts, and a shorter spring 14 which is connected with the moving contact 10 via a flexible lead 15. The sectional view of FIG. 1 shows only one set of spring mounted contacts 10, 12 and 13, but the described embodiment really has three sets of contacts as can be seen in FIG. 2. In the following the individual contact sets will be referred to as A, B, and C and the respective contacts 10A, 12A and 13A etc. A coil spring 16 connects the short end of armature 7 with a pin 17 protruding from the base of frame 1 and serves to maintain the switch in the open position until it is manually closed. A mounting block 18 straddles the coil spring 16 and serves as a mounting point for the assembly inside a sheet metal enclosure 19.

Figure 3:
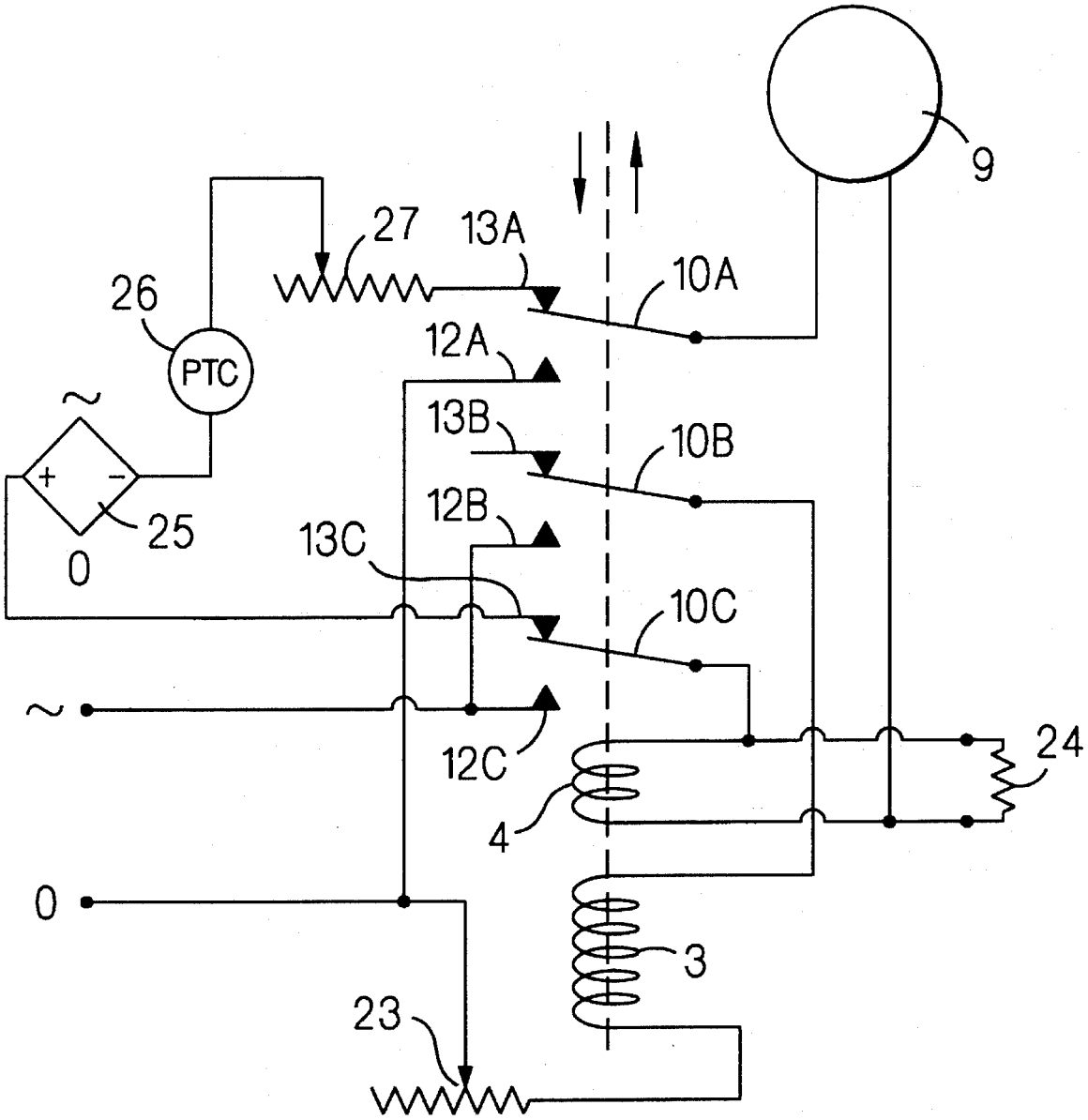
FIG. 3 is a circuit diagram illustrating a switch according to the invention used to control an electric motor.

It will be obvious to persons skilled in the art that the structure described thus far has similarities with common embodiments of electromagnetic relays, but for a few important differences which will be described in the following with reference to the circuit diagram of FIG. 3.

1. An elongated plate 20 is attached to the armature 7 extending beyond its fulcrum point through a hole in the enclosure 19. A Rocker element 21 serving as manual switch operator is attached to the protruding end of plate 20 and surrounded by a U shaped guard 22 serving to prevent inadvertent operation of the switch.

2. Armature and contact clearances are much larger than normally seen in an electromagnet relay.

3. The clearance between contacts 10B and 12B has been reduced relative to the clearances of contact sets A and C in the shown embodiment. This has been accomplished simply by bending spring 12B thus bringing its contact marginally closer to the moving contact 10B.

The circuit diagram shows the described switch used to control a single phase electromotor 9 via the normally open contact sets 10A, 12A and 10C, 12C which serve to simultaneously make or break the neutral and line connections to the motor.

The switch is closed by manually depressing the left side of the rocker operator thereby closing the armature against the force of coil spring 7. Due to the reduced clearance between contacts 10B and 12B these close marginally earlier than contact sets A and C, thus energizing coil 3 causing the magnetic force to take over and momentarily close contacts A and C to start the motor. The current flowing through the motor also flows through the series connected coil 4 consisting of few turns of relatively heavy wire and arranged to counteract the field set up by coil 3. It will be clear that during operation coil 3 and its circuit act as means to hold the switch closed. The switch can be opened in four ways, namely;

1. Manually, by depression of the right hand side of the rocker operator. This will break armature 7 away from the core 2 against the magnetic force and open all contact sets.
2. By opening a normally closed contact in the holding circuit. This can be a limit switch operated by removing a guard or a timer or counter signaling the end of a working cycle.
3. In case of a power failure. The switch will remain open even after power is restored until it is again closed by hand.
4. By mechanically overloading or stalling the motor. This will cause the current flowing through coil 4 to rise, and since this is wound and connected in order to produce a field contrary to that of coil 3, as the current increases, eventually the force of coil spring 7 will overcome the remaining magnetic attraction and open the switch.

In a magnetic circuit the force of attraction between an armature and a pole is very much dependent on the relative clearance, and the amount of power required to close a relay or contactor increases exponentially with the clearance. Obviously in a switch according to the invention the magnetic force only has to keep the armature closed, or to close it the last fraction of its way subsequent to the closing of the operating contact 10B–12B, and this means that clearances can be generous to provide added safety against arching and short circuit.

It also means that the amount of power required in the holding circuit is much less than the amount required to operate a conventional relay of similar contact rating. According to the invention this feature provides an easy means for pre-selecting the overload trip current by inserting a variable resistance 23 in the holding circuit, serving to adjust the amount of power taken up by coil 3. Because very little power is required to hold the switch closed, a potentiometer dimensioned to dissipate a watt or less is sufficient for adjusting the tripping torque within wide limits. The switch can be adapted for a different range of motor sizes either by changing the wire gauge and number of turns in coil 4, or, after selecting the most sensitive combination, by means of a shunt resistor 24 inserted in parallel with coil 4.

In many cases the operator will want to select a maximum trip torque near or even below the motor's rated full load torque and in such cases, since the start-up current is often 3–4 times the full load current, in order to turn the motor on the operator will have to keep the rocker depressed until the speed has build up and the current has dropped back to normal. Usually this takes only about a second dependent on the inertia in the system, and contrary to being a nuisance the brief holding period provides the operator with a safety promoting feedback.

A final safety feature which may conveniently be integrated into a switch according to the invention is a braking circuit to prevent dangerous coasting of work spindles after the current has been cut. It is known to brake coasting Alternating Current motors by injecting a brief pulse of Direct Current, in the following, referred to as AC and DC respectively, immediately as the AC is cut and this will cause the motor to operate as a generator into a partial short circuit and slow it down within a few seconds dependent on the strength of the DC current and pulse duration. The DC injection is usually done via an extra set of contacts in the starter relay but, due to DC/reactance, the combination requires very generous contact clearances in order to prevent short circuits and contact burning due to arching. It is an advantage of the switch according to the invention that clearances can be several times those normally available in relays or motor starters and this means a virtual elimination of the danger of arching.

Also according to the invention the DC pulse can be supplied from the line through a circuit which contains a full wave rectifier 25, a Positive Temperature Coefficient resistor 26, in the following referred to as a PTC, and an adjustable resistor 27 which may serve to adjust the braking current and pulse duration. The braking circuit is energized as the switch is opened thus closing contacts 10A–13B and 10C–13C which will cause DC current to flow in the braking circuit and motor windings. This will cause the motor to slow down rapidly and simultaneously the PTC resistor will start heating up until it reaches its transition temperature. At this point the PTC resistance increases to many times its original value and reduces the current to a value just sufficient to keep the PTC temperature high. The temperature will remain high until the motor is restarted and the braking circuit opened, at which time the temperature of the PTC will drop beyond its transition point in a matter of seconds and the circuit is ready to provide a new braking pulse.

While a particular embodiment of the invention has been shown and described it is understood that many variations are possible within the general scope of the invention.

Examples of obvious variations include the exchange of the rocker operator with a toggle arm or a separate on push-button to close the magnetic circuit and an off push button break it open. Other obvious variations would be various modifications to the configuration of the magnetic circuit including straight, unhinged versions with a push-pull operator and variations in the number of contact sets to meet specific requirements. More obvious modifications inside the scope of the invention would be incorporation of a light signaling the switch position, and exchanging the variable resistors mentioned with fixed resistors determining the release current and the braking torque and duration respectively.

What is claimed is:

1. An on-off switch, having ON and OFF states, for connecting a source of electrical current to a load, said switch comprising:

(a) a magnetizable core surrounded by windings to form a holding coil to magnetize said core when electrical current is passed through said windings;

(b) an armature manually moveable between ON and Off positions, corresponding to said ON and Off states, and carrying thereon at least a first contact arranged to interact with a similar number of stationary contacts;

(c) manual movement of said armature from said OFF position to said ON position will cause current to flow in said windings to magnetize said core, with said core magnetically engaging said armature and holding said armature in said ON position; and (d) manual movement of said armature from said ON position to said OFF position will cause cessation of current flow in said windings to demagnetize said core.

2. An on-off switch, as defined in claim 1, wherein: said current will flow in said windings as a result of said first contact engaging one of said stationary contacts.

3. An on-off switch, as defined in claim 2, further comprising:

(a) at least one operating contact disposed on said armature, contact of said operating contact with one of said stationary contacts will cause said load to be connected to said source of electrical current; and (b) said first contact engages said one of said stationary contacts marginally earlier than said at least one operating contact engages said one of said operating contacts, when said armature is moved from said OFF position to said ON position.

4. An on-off switch, as defined in claim 3, wherein:

(a) at least a portion of said current to said load is to be directed through a load coil to produce a magnetic field which counteracts the magnetic field produced by said windings; and (b) when said current to said load reaches a predetermined level, said armature will be released from said core.

5. An on-off switch, as defined in claim 1, wherein: said holding coil has attenuation means in series therewith to select the strength of said magnetic field produced by said holding coil.

6. An on-off switch, as defined in claim 1, wherein: said load is an alternating current electromotor and rapid braking action will be provided upon shutdown by injecting a brief pulse of direct current into field windings of said electromotor via the closing of a set of contacts as said armature is moved from said ON position to said OFF position.

7. An on-off switch, as defined in claim 6, wherein: said direct current is provided by a full wave rectifier connected in series with a positive temperature coefficient resistor and attenuation means.

8. An on-off switch, having ON and OFF states, for connecting a source of electrical current to a load, said switch comprising:

(a) a magnetizable core surrounded by windings to form a holding coil to magnetize said core when electrical current is passed through said windings and place said switch in said ON state;

(b) at least a portion of said current to said load will be directed through a load coil to produce a magnetic field which counteracts the magnetic field produced by said windings; and (c) when said current to said load reaches a predetermined level, said switch will change from said ON state to said OFF state.

9. An on-off switch, as defined in claim 8, further comprising:

(a) an armature manually moveable between ON and OFF positions, corresponding to said ON and OFF states, and carrying thereon at least a first contact arranged to interact with a similar number of stationary contacts; and (c) manual movement of said armature from said OFF position to said ON position will cause current to flow in said windings to magnetize said core, with said core magnetically engaging said armature and holding said armature in said ON position.

10. An on-off switch, as defined in claim 9, wherein: manual movement of said armature from said ON position to said OFF position will cause cessation of current flow in said windings to demagnetize said core.

11. An on-off switch, as defined in claim 9 wherein: said current will flow in said windings as a result of said first contact engaging one of said stationary contacts.

12. An on-off switch, as defined in claim 11, further comprising:

(a) at least one operating contact disposed on said armature, contact of said operating contact with one of said stationary contacts will cause said load to be connected to said source of electrical current; and (b) said first contact engages said one of said stationary contacts marginally earlier than said at least one operating contact engages said one of said operating contacts, when said armature is moved from said OFF position to said ON position.

13. An on-off switch, as defined in claim 8, wherein: said holding coil has attenuation means in series therewith to select the strength of said magnetic field produced by said holding coil.

14. An on-off switch, as defined in claim 9, wherein: said load is an alternating current electromotor and rapid braking action will be provided upon shutdown by injecting a brief pulse of direct current into field windings of said electromotor via the closing of a set of contacts as said armature is moved from said ON position to said OFF position.

15. An on-off switch, as defined in claim 14, wherein: said direct current will be provided by a full wave rectifier connected in series with a positive temperature coefficient resistor and attenuation means.

16. An on-off switch, having ON and OFF states, for connecting a source of electrical current to a load, said switch comprising:

(a) a magnetizable core surrounded by windings to form a holding coil to magnetize said core when electrical current is passed through said windings;

(b) a moveable contact structure, moveable between ON and OFF positions corresponding to said ON and OFF states, and having thereon at least first and second contacts engagable with a similar number of stationary contacts, engagement of said first contact with one of said stationary contacts to provide current to said windings, and engagement of said second contact with one of said stationary contacts to cause said load to be connected to said source of electrical current; and (c) said first contact engages said one of said stationary contacts marginally earlier than said second contact engages said one of said operating contacts, when said contact structure is moved from said OFF position to said ON position.

17. An on-off switch, as defined in claim 16, wherein: said contact structure is an armature and manual movement of said armature from said OFF position to said ON position will cause current to flow in said windings to magnetize said core, with said core magnetically engaging said armature and holding said armature in said ON position.

18. An on-off switch, as defined in claim 17, wherein: manual movement of said armature from said ON position to said OFF position will cause cessation of current flow in said windings to demagnetize said core.

19. An on-off switch, as defined in claim 17, wherein:

(a) at least a portion of said current to said load is directed through a load coil to produce a magnetic field which counteracts the magnetic field produced by said windings; and (b) when said current to said load reaches a predetermined level, said armature is released from said core.

20. An on-off switch, as defined in claim 19, wherein: said holding coil has attenuation means in series therewith to select the strength of said magnetic field produced by said holding coil.

21. An on-off switch, as defined in claim 17, wherein: said load is an alternating current electromotor and rapid braking action will be provided upon shutdown by injecting a brief pulse of direct current into field windings of said electromotor via the closing of a set of contacts as said armature is moved from said ON position to said OFF position.

22. An on-off switch, as defined in claim 21, wherein: said direct current is provided by a full wave rectifier connected in series with a positive temperature coefficient resistor and attenuation means.

* * * * *